US010349737B2

(12) United States Patent
Keller et al.

(10) Patent No.: US 10,349,737 B2
(45) Date of Patent: Jul. 16, 2019

(54) HEIGHT-ADJUSTABLE FRAME WITH FOLDABLE LEG ELEMENTS

(71) Applicant: Vitra Patente AG, Birsfelden (CH)

(72) Inventors: Stefan Keller, Steinen-Hofen (DE); Helmut Schütt, Müllheim-Hügelheim (DE)

(73) Assignee: VITRA PATENTE AG, Birsfelden (CH)

( * ) Notice: Subject to any disclaimer, the term of this patent is extended or adjusted under 35 U.S.C. 154(b) by 0 days.

(21) Appl. No.: 15/786,780

(22) Filed: Oct. 18, 2017

(65) Prior Publication Data

US 2018/0110324 A1 Apr. 26, 2018

(30) Foreign Application Priority Data

Oct. 20, 2016 (EP) ..... 16194820

(51) Int. Cl.

| | |
|---|---|
| ***A47B 9/14*** | (2006.01) |
| ***A47B 3/08*** | (2006.01) |
| ***A47B 9/00*** | (2006.01) |
| *A47B 9/04* | (2006.01) |

(52) U.S. Cl.

CPC ..... *A47B 9/14* (2013.01); *A47B 3/08* (2013.01); *A47B 3/0812* (2013.01); *A47B 9/00* (2013.01);

(Continued)

(58) Field of Classification Search

CPC ..... A47B 3/08; A47B 2003/025; A47B 2003/0824; A47B 9/00; A47B 9/043; A47B 2009/043

(Continued)

(56) References Cited

U.S. PATENT DOCUMENTS 2,783,109 A * 2/1957 Frey ..... A47G 23/0608 108/115
2,978,012 A * 4/1961 Norseen ..... A47C 4/20 108/116

(Continued)

FOREIGN PATENT DOCUMENTS

| | | |
|---|---|---|
| EP | 2 926 688 A1 | 10/2015 |
| EP | 2 979 579 A1 | 3/2016 |
| JP | S57 45335 U | 3/1982 |

OTHER PUBLICATIONS

European Search Report for EP 16 194 820.3, dated Apr. 25, 2017.

*Primary Examiner* — Jose V Chen
(74) *Attorney, Agent, or Firm* — Medler Ferro Woodhouse & Mills PLLC

(57) ABSTRACT

A height-adjustable frame for furniture, such as a worktable or desk, is disclosed. The frame includes first and second height-adjustable leg elements pivotable about first and second pivot axes between folded-out and folded-in positions. A rotatable shaft is arranged between the first and second leg elements to synchronously drive first and second height adjustment arrangements. The shaft includes a middle section and first and second end sections pivotable towards the middle section about respective first and second joint axes. A locking structure is included that locks the first and second leg elements in a folded-out position, when the first and second joint axes do not run approximately parallel to the first and second pivot axes, and that unlocks when the first and second joint axes run approximately parallel to the first and second pivot axes to permit the first and second leg elements to pivot into a folded-in position.

17 Claims, 3 Drawing Sheets

(52) U.S. Cl.
CPC . *A47B 2003/0824* (2013.01); *A47B 2009/043* (2013.01)

(58) Field of Classification Search
USPC ..... 108/147, 144.11, 147.19, 147.22; 248/188.1, 188.5, 188.6
See application file for complete search history.

(56) References Cited

U.S. PATENT DOCUMENTS 3,080,835 A * 3/1963 Guglielmi ..... A47B 9/10 108/116
3,606,450 A * 9/1971 Sedgwick ..... A47C 7/68 108/129
3,859,930 A * 1/1975 Sherwin ..... A47B 3/0916 108/32
4,043,277 A * 8/1977 Wallace ..... A47B 3/083 108/35
4,228,745 A * 10/1980 Gale ..... A47C 9/08 108/116
4,754,713 A * 7/1988 Chatenay epouse Connpagnone ..... A63J 1/00 100/144
5,553,550 A * 9/1996 Doyle ..... A47B 9/00 108/147
5,706,739 A * 1/1998 Shaheen ..... A47B 9/02 108/146
6,289,825 B1 * 9/2001 Long ..... A47B 9/00 108/147
7,086,632 B2 * 8/2006 Hsieh ..... G10H 1/32 108/147
8,104,410 B2 * 1/2012 Lanfear ..... A47B 9/20 108/13
8,276,526 B2 * 10/2012 Verweij ..... A47B 9/20 108/147
9,271,567 B2 * 3/2016 Wu ..... A47B 3/002
D819,371 S * 6/2018 Cao ..... D6/656.16
2002/0046684 A1 * 4/2002 Lin ..... A47B 3/0815 108/133
2004/0083932 A1 * 5/2004 Kottman ..... A47B 3/00 108/115
2008/0178779 A1 * 7/2008 Agee ..... A47B 9/04 108/147
2010/0089294 A1 * 4/2010 Medina ..... A47B 3/0913 108/25
2010/0258042 A1 * 10/2010 Rutz ..... A47B 3/0818 108/115
2018/0242728 A1 * 8/2018 Hansen ..... A47B 3/0818

* cited by examiner

HEIGHT-ADJUSTABLE FRAME WITH FOLDABLE LEG ELEMENTS

TECHNICAL FIELD

The invention relates to a height-adjustable frame according to the preamble of independent claim 1.

BACKGROUND OF INVENTION

Workstations with height-adjustable worktops have long been known, particularly in the form of office or workshop tables. By being able to adjust the height, i.e. the vertical direction of the worktops, the workstation can be optimally adapted to the height of an individual working at said workstation. This may be an important requirement for an ergonomic and, in particular, a working posture that is sparing on the spine and back.

Whereas previously height adjustability was often only possible to a relatively limited extent in order to be able to compensate for height differences within the range of a statistically relative standard deviation of heights of seated adult individuals, nowadays worktops, particularly of desks with increased height adjustability, which allow work to be carried out while standing if required, are very popular. Since carrying out work for a long time while standing may be found to be unpleasant and/or tiring, the fast adjustability of the heights of the worktop suitable for working while standing and sitting, without complication, is important. In particular, frequent adjustment of the vertical position of the worktop to a sufficient degree should be possible without problems.

In order to be able to utilise office areas and storage areas, inter alia, as flexibly as possible, office or desk or workshop tables are in particular provided in parallel in which the frame or legs can be folded in and out with respect to the worktop. However, difficulties may arise with embodiments that can be folded in and out when height-adjustability is also supposed to be provided.

As is known, height-adjustability is frequently implemented using an electric drive. A table frame is described in EP 2 926 688 A1 in which two height-adjustable table legs are connected via a long support body. The table legs each comprise a console on their upper ends in which an electric drive is respectively provided for the associated table leg. In order to fold in the table legs, the consoles, together with the rest of the associated table legs and the associated drive, are folded in towards each other.

However, since electric drives require electric energy and thus, in particular, a connecting cable or similar, such frames are often undesirable. They can also be proportionately susceptible to faults or defects. Mechanically height-adjustable workstations are accordingly favoured as alternatives, but typically they cannot be folded in. In particular, the mechanics in most cases prevent the legs or the frame from folding in.

Against this background, an object of the invention is to propose a height-adjustable frame for furniture such as a table and, in particular, a desk or work table which is easy to construct, can be operated without electric energy and can be folded together saving as much space as possible.

SUMMARY OF THE INVENTION

This and further objects are achieved by a height-adjustable frame as defined by the features of independent claim 1 and by a table as defined by the features of independent claim 15. Advantageous embodiments of the invention are indicated in the dependent claims.

The invention proposes a height-adjustable frame for furniture such as a table and, in particular, a desk or work table. The frame comprises a first leg element with a first support section, a first foot section and a first adjustment arrangement. Furthermore, it comprises a second leg element with a second support section, a second foot section and a second adjustment arrangement.

The first support section and the first foot section can be moved relative to each other by means of the first adjustment arrangement. The second support section and the second foot section can be moved relative to each other by means of the second adjustment arrangement. The first leg element can be pivoted about a first pivot axis and the second leg element can be pivoted about a second pivot axis.

In particular, the frame has a locking structure and a rotatable shaft arranged between the first leg element and the second leg element to synchronously drive the first adjustment arrangement and the second adjustment arrangement. The shaft comprises a middle section, a first end section pivotable towards the middle section about a first joint axis and a second end section pivotable towards the middle section about a second joint axis. The locking structure locks the first leg element and the second leg element in a folded-out position when the joint axes do not run at least approximately parallel to the pivot axes or, in particular, at least approximately collapse together. The locking structure can be unlocked when the joint axes run at least approximately parallel to the pivot axes and in particular at least approximately collapse together such that the first leg element and the second leg element can be pivoted into a folded-in position.

The term "frame" may, in particular, relate to a support frame by means of which the furniture can be stabilised on the floor. The frame may, in particular, be a table frame or a table framework.

The term "worktop" can generally relate to a plate-shaped element in the context of the invention, which element can be mounted on the height-adjustable frame and on which an activity is carried out. The worktop may, in particular, be a table top. Such worktops have a horizontal surface in many applications. Deviations from a precisely horizontal orientation may also be included. The worktops can, however, also be arranged tilted or inclined.

The term "pivot" with regard to the end sections and leg elements may relate to folding in and folding out. In this case, the leg elements can, in particular, be folded in and out in relation to a worktop or table surface on which they are mounted. The end sections can also be folded in or out here The first and the second leg element can be pivoted about a first or second pivot axis such that each of the leg elements can preferably be adjusted individually by means of pivoting between a folded-in and a folded-out position. The frame can be placed on the floor or on another, preferably flat surface by means of the leg elements, in particular the foot sections when they are in the folded-out position.

The first adjustment arrangement and the second adjustment arrangement are advantageously designed so that they can be actuated by rotating a respective adjustment element and depending on the direction of rotation, the associated foot section is thereby displaced. In this case, the respective adjustment element may, in particular, be a gear which is in operative connection with a rack or spindle provided on the corresponding foot section and, in particular, fixedly connected to the foot section.

For height adjustment, particularly for synchronous actuation of the first and second adjustment arrangement, a shaft running between the leg elements is provided which is arranged to actuate the respective adjustment elements of the first and second leg element synchronously when it rotates about a longitudinal axis. For example, it can actuate the gears in a rotating manner and thereby displace the rod or spindle connected thereto. A gear can also be provided at each end of the shaft which, as mentioned previously, engages with the racks or spindles provided on the foot sections and serves as a first or second adjustment element.

The shaft is designed as at least a three-part shaft according to the invention and comprises the middle section, the first end section connected for example via a first joint to the middle section as well as to the second end section connected for example via a second joint to the middle section. The joints are preferably universal joints with a single degree of freedom which respectively define each of the joint axes running, in particular, perpendicular to the middle section of the shaft. The end sections together with the respectively associated leg element can be pivoted about these joint axes. The two joints can, however, also be designed with a plurality, in particular, two degrees of freedom, for example as a universal, ball or cardan joint. Joints of this type generally have a preferred direction or a preferred degree of freedom for technical reasons in which, or in relation to which, pivoting or rotation is enabled with particularly low friction, low resistance and/or over a particularly large adjustment range, particularly in comparison to other directions or in relation to other degrees of freedom. In such a case, the axis corresponding to the preferred direction or to the preferred degree of freedom can be understood as the respective joint axis in the context of the present invention, in particular insofar as it runs perpendicularly to the middle section of the shaft.

The end sections connected to the middle section via the joint axes enable the latter to be pivoted or folded in and out simultaneously with the leg elements, provided the degrees of freedom of the joints allow this. In order to ensure clean pivoting, this is only possible according to the invention when the joint axes run at least approximately parallel to the respective pivot axes of the leg elements or, in particular, coincide at least approximately with the respective pivot axes.

In order to rotate the shaft about its longitudinal axis, a winder element is preferably provided which is in operative connection with the shaft so that the shaft can be put into rotation by rotating the winder element or winder. In this case, the winder can, in particular, have a winder rod on whose one end a first bevel gear is provided, in particular fixedly connected, which engages or can be engaged with a bevel gear provided on the shaft, in particular fixedly connected to the shaft. Alternatively, however, a motor can also be provided, in particular an electric motor by means of which the shaft can be put into rotation. If the shaft is rotated, the two joints and thus also the two joint axes rotate simultaneously. However, this leads to the joint axes generally not running parallel to the pivot axes, not even approximately.

However, if the first or second joint axes do not run at least approximately parallel to the first or second pivot axes or if the joint axes do not coincide at least approximately with the respective pivot axes, pivoting of the corresponding leg element is blocked or made impossible by the shaft. In particular, this serves to ensure that that the corresponding leg element or the shaft and/or other elements of the height-adjustable frame are not damaged.

To this end, provision is made, according to the invention, for a locking structure which is designed, in particular, to lock the leg elements in the folded-out position, i.e. to block pivoting of the leg elements when the first joint axis does not run at least approximately parallel to the first pivot axis and the second joint axis does not run at least approximately parallel to the second pivot axis. However, the locking structure releases the leg element when the first joint axis runs at least approximately parallel to the first pivot axis or when the first joint axis and the first pivot axis at least approximately coincide and the second joint axis also runs at least approximately parallel to the second pivot axis or when the second joint axis and the second joint axis at least approximately coincide. In the folded-out position, the shaft is preferably located in a linear or extended position in which the middle section and the two end sections extend in one and the same direction or are located on a straight axis, i.e. are not pivoted towards each other.

The provision of a locking structure as previously described allows the end sections of the shaft to connect to the middle section with only one degree of freedom by means of universal joints, for example, which allows a particularly easy, robust and stable construction of the shaft without impairing the pivotability of the leg elements. The two joint axes are in this case preferably orientated in parallel.

The frame preferably comprises a support element for mounting on a worktop or a table top on which the first leg element is mounted pivotably about the first pivot axis and on which the second leg element is mounted pivotably about the second pivot axis. Such a support element can carry and support a worktop or table top. The frame can be designed efficiently as a stable substructure of a table.

In this case, the support element is advantageously designed in one piece. It preferably has a transverse section on which the first leg element and the second leg element are mounted spaced apart from each other. The transverse section may, for example, be designed in the form of a profiled tube, a transverse beam or a square tube. When mounted it can extend substantially parallel to a direction of a width or the worktop. In this case, a first bearing can be provided in the region of a first end of the transverse section and a second bearing can be provided in the region of a second end of the transverse section remote from the first end. A first or second longitudinal section can also be provided in the region of the first and second end of the cross-section, which extends at least substantially in a longitudinal direction running perpendicular to the transverse direction. The longitudinal sections can thus extend parallel to a direction of a depth of the worktop and thus support the worktop in front and behind.

The transverse sections may also be designed as screens or linings for the shaft, wherein at least one part of the shaft in particular runs in a cavity formed in or by the transverse section, possibly in connection with the worktop.

The support element may, however, also be designed in multiple parts and comprise a first mounting part with the first bearing and a second separate mounting part with the second bearing. In the case of a two-part support element of this type, the transverse section is replaced or formed to some extent by a region of the worktop when the two-piece support element is mounted on such. Moreover, the support element can also be designed in one piece with the worktop or be connected in a fixed, in particular materially-bonded manner to said worktop. For example, the support element can be formed, welded or soldered onto the worktop in the case of a worktop made from metal.

The first pivot axis and the second pivot axis are advantageously parallel to and different from each other. They can in particular be orientated parallel to the longitudinal direction or parallel to a direction of a depth of the worktop when the frame is mounted on the table top.

The support element enables a stable and fixed connection between worktop and frame. If required, the support element and leg element can be designed so that the leg elements can be mounted and dismounted using suitable tools, for example. This allows simple, factory manufacture or easy mounting on-site, enabling a modular and/or configurable product range to be made available.

The first leg element and the second leg element are preferably respectively pivotable between the folded-in position and the folded-out position independently of each other.

In a preferred embodiment of the frame, the locking structure comprises a blocking arrangement which can be adjusted between a blocking position, in which it blocks the pivoting of the first and second leg element, and a release position, in which the first and the second leg element are released for pivoting. In this case, a single, common blocking arrangement can be provided which blocks or releases the pivoting of both leg elements simultaneously. However, one blocking arrangement can also be provided for each leg element, which arrangement only bocks or releases the pivoting of the corresponding leg element. Such a blocking arrangement allows an efficient design and actuation of the locking structure.

The locking structure preferably changes depending on a rotation position of the shaft between the blocking position and the release position. It is hereby possible to efficiently fold the leg elements automatically only in suitable positions. In particular, folding-in is only possible by rotating all three sections of the shaft and, if necessary, the joints present, when the joints are suitably aligned.

In this case, the locking structure preferably comprises an eccentric provided on the shaft by means of which the blocking arrangement can be adjusted between the blocking position and the release position, depending on the rotation position of the shaft. The blocking arrangement can be efficiently and reliably actuated by means of such an eccentric, depending on the rotation position. The eccentric may have a non-rotationally symmetric outer circumference. For example, it may have a protrusion in the circumferential direction. The unround outer circumference of the eccentric can move part of the blocking arrangement, depending on the rotation position of the shaft, and thus actuate it. Two analogous eccentrics are preferably arranged respectively on the end sections of the shaft.

In this case, the blocking arrangement of the locking structure preferably comprises a first locking pin, which protrudes in the blocking position into a first recess which is formed in the folded-out position of the first leg element on the first leg element and on the support element, and a second locking pin, which protrudes in the blocking position into a second recess which is formed in the folded-out position of the second leg element on the first leg element and on the support element. Such locking pins can efficiently and securely block the leg elements. In this case, the recess can be an opening and/or a depression. The term "protrude into" also includes "protrude through" in this context.

The blocking arrangement of the locking structure is preferably pretensioned resiliently in the direction of the release position. The blocking arrangement can thus always be moved into the release position when it is not pressed onto another point. Alternatively, the blocking arrangement of the locking structure can also be pretensioned resiliently in the direction of the locking position.

In this case, the first locking pin and the second locking pin are preferably pressed in the blocking position resiliently into the first recess and into the second recess, and in the release position are moved by the eccentric out of the first recess and the second recess. The eccentric can thus push the locking pins out of the recesses against a spring force.

In the embodiments of the frame according to the invention, the blocking arrangement may, in particular, comprise a locking pin which can protrude into a first guide opening in the blocking position, or may protrude through a first guide opening which is formed on the first leg element and also protrudes into a first blocking depression or opening or protrudes through a first locking depression or opening which is provided on the support element, in particular on the first mounting part so that the first guide opening and first blocking depression or opening are covered in the folded-out position of the first leg element and/or protrude into a second guide opening in the blocking position, or protrude through a second guide opening which is formed on the second leg element and also protrude into a second blocking depression or opening, or protrude through a second blocking depression or opening which is provided on the support element, in particular on the second mounting part, so that the second guide opening and the second locking depression or opening are covered in the folded-out position of the second leg element.

In the release position, the locking pin can be adjusted so that it no longer protrudes into the first or second blocking depression or opening. The blocking depression or opening and guide opening preferably have an at least approximately identical cross-section, which is preferably designed so that the locking pin or at least one end of the locking pin can be inserted at least approximately in a firmly-bonded manner into the blocking depression or opening and/or the guide opening. The guide opening and/or the first or second blocking depression or opening can, in particular, be designed as drilled holes, preferably with an at least approximately identical diameter.

The shaft preferably runs in an interior space of the transverse section of the support element. Such an arrangement of the shaft can efficiently protect this. The prevention of a clean rotation of the shaft can also be avoided.

A first universal joint forming the first joint axis is preferably provided between the middle section and the first end section of the shaft, and a second universal joint forming the second joint axis is preferably provided between the middle section and the second end section of the shaft. Such universal joints can provide a reliable rotation of the entire shaft and also stable tilting or pivoting of the end sections together with the leg elements.

The middle section of the shaft, the first end section of the shaft and the second end section of the shaft are each preferably rod-shaped. Such a embodiment provides a stable structure which is uniformly and efficiently rotatable.

A further aspect of the invention relates to a table with a height-adjustable frame, as described above, and to a worktop or table top which is mounted on the frame. Such a table enables the effects and advantages described in connection with the frame according to the invention and its preferred embodiments to be implemented efficiently.

BRIEF DESCRIPTION OF THE DRAWINGS

Further advantageous embodiments of the invention result from the following description of exemplary embodiments of the invention with the aid of the schematic drawing. In particular, the frame according to the invention is described in more detail below with reference to the attached drawings based on exemplary embodiments.

DETAILED DESCRIPTION OF EMBODIMENTS OF THE INVENTION

Figure 1:
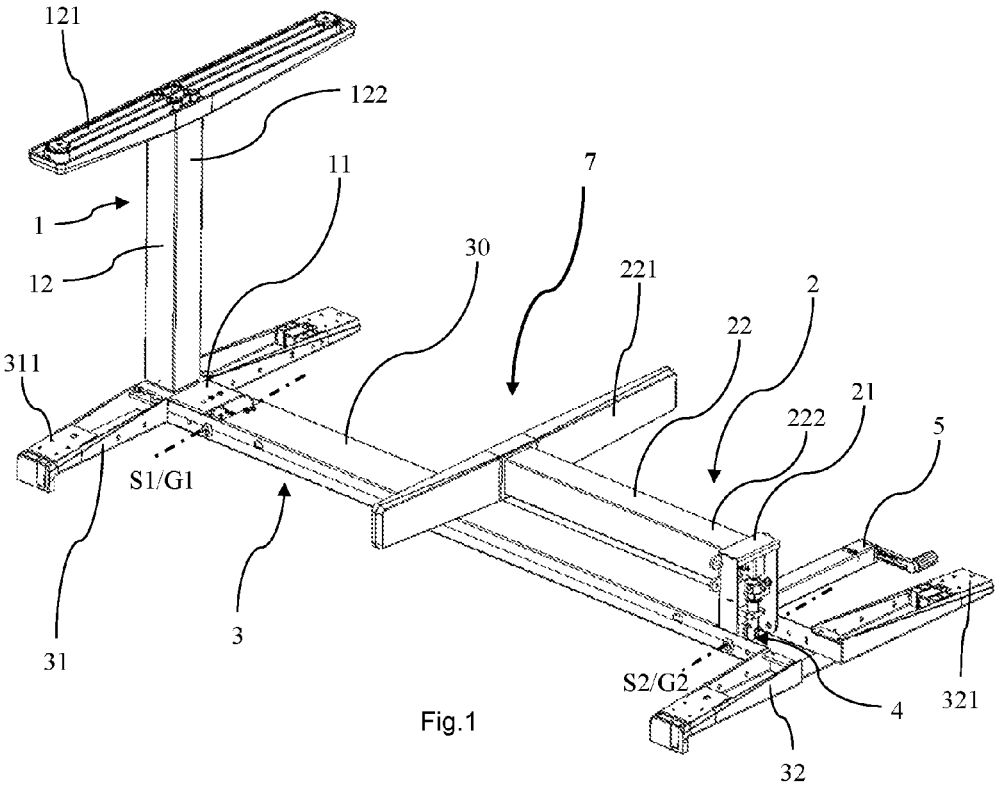
FIG. 1 shows a perspective view of a preferred embodiment of a height-adjustable frame according to the invention.

Certain expressions are used in the following description for practical reasons and should not be understood to limiting in scope. The words, "right", "left", "down" and "up" refer to directions in the drawing to which reference is made. The expressions "inwards", "outwards", "below", "above", "left", "right" or similar are used to describe the arrangement of labelled parts with respect to each other, the movement of specified parts with respect to each other and the directions towards or away from the geometric centre of the invention as well as named parts of the same as illustrated in the Figures. This spatial relative information also comprises positions and alignments other than those illustrated in the Fig. For example, when a part illustrated in the figures is rotated, elements or features which are described as "below", are then "above". The terminology includes the words expressly mentioned above, derivations thereof and words with similar meaning.

In order to avoid repetitions in the figures and in the associated description of the different aspects and exemplary embodiments, certain features should be understood as common to different aspects and exemplary embodiments. The omission of one aspect in the description or in a figure does not mean that this aspect is missing in the associated exemplary embodiment. In fact, such an omission can serve to improve clarity and avoid repetitions. In this connection, the following definition applies to the entire remainder of the description. If reference numerals are included in a figure for the purpose of schematic clarity, but they are not mentioned in the directly associated text of the description, then reference is made to their explanation in the preceding descriptions of figures. However, if reference numerals are mentioned in the text of the description directly associated with a figure, but are not mentioned in the associated figure, then reference is made to the preceding and following figures. Similar reference numerals in two or more figures denote similar or identical elements.

Figure 2:
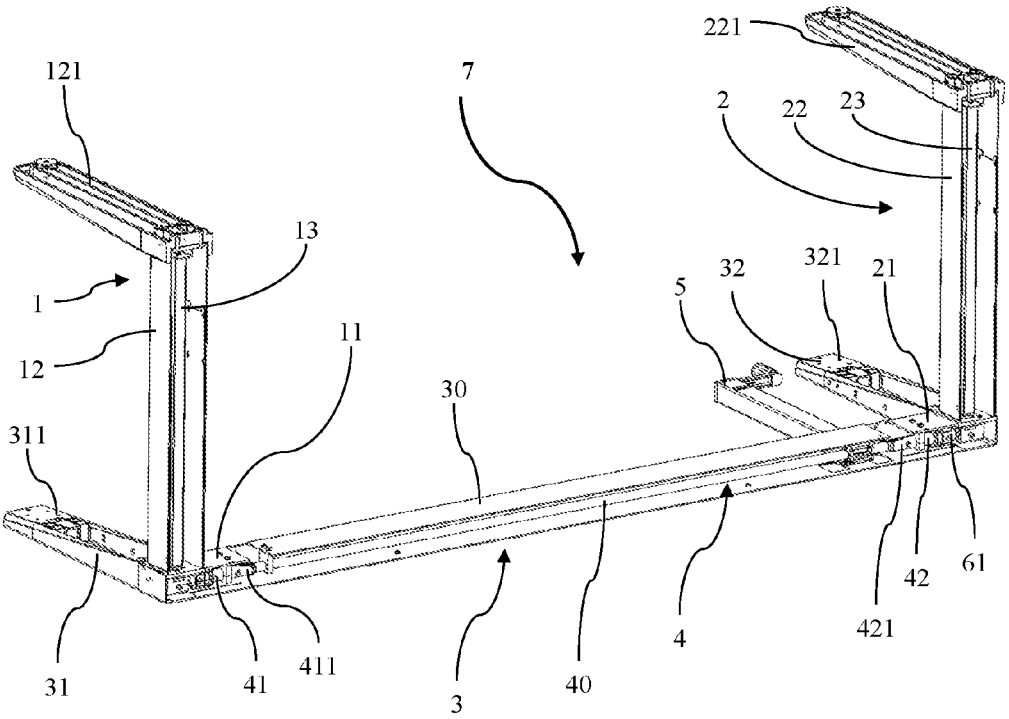
FIG. 2 shows a perspective view of the frame of FIG. 1 partially opened.

FIG. 1 shows an exemplary embodiment of a height-adjustable frame 7 according to the invention reversed from one side, and FIG. 2 shows the frame 7 from an opposing side. The frame 7 is illustrated partly open in FIG. 2, thus components in the interior of the frame 7 are visible.

The frame 7 comprises a support element 3 in the region of its longitudinal ends, a first leg element 1 and a second leg element 2 being mounted on a first and second bearing element independently of each other pivotable about a first pivot axis S1 and second pivot axis S2 respectively. The first leg element 1 is located in FIG. 1 in a folded-out and pivoted-out position, and the second leg element 2 is located in a folded-in and pivoted-in position respectively.

The support element 3 comprises a transverse beam 30 which runs in a transverse direction which, in particular, corresponds to a direction of a width of a worktop or table top provided for mounting on the frame 7. The support element 3 also comprises a first longitudinal section 31 and a second longitudinal section 32 which run in a longitudinal direction corresponding, in particular, to a direction of a depth of the worktop provided for mounting on the frame 7. The support element 3 and thus the frame 7 can be mounted on its longitudinal sections 31 and 32 on an underside of the worktop or table top and together with it form a table. It can, for example, be fastened by means of screws which are screwed through drilled holes 311, 321 into the worktop or table top.

The first leg element 1 comprises a first support section 11 and a first foot section 12. The second leg element 1 comprises a second support section 21 and a second foot section 22. The first foot section 12 and the second foot section 22 each comprise a square tube 122, 222 and a longitudinal foot 121, 122. The longitudinal feet 121, 122 are aligned parallel to each other and parallel to the longitudinal sections 31, 32 of the support element 3. The foot sections 12, 22 are mounted on the respective support sections 11, 21 so as to be retractable and extendible by means of a first adjustment arrangement 13 and a second adjustment arrangement 23.

If the support element 3 and thus the frame 7 are mounted on a worktop, a vertical position of the worktop can be adjusted by retracting or extending the foot sections 12, 22 by means of the adjustment arrangement 13, 23. If the foot sections 12, 22 are extended, a distance between the foot sections 12, 22 and the support sections 11, 21 or the support element 3 is increased. A vertical position or height of the worktop can thus be increased or enlarged. If the foot sections 12, 22 are retracted, a distance between the foot sections 12, 22 and the support element 3 is reduced and a vertical position of the worktop is lowered.

In order to actuate the adjustment arrangement 13, 23 and ensure that the two foot sections 12, 22 are always retracted or extended synchronously, a shaft 4 is provided which runs between the first and second leg elements 11, 21 and can be put into rotation by means of a winder element 5. In this case, the two adjustment arrangement 13, 23, with which the shaft 4 is in operative connection, are actuated synchronously.

The shaft 4 comprises an at least substantially rod-shaped middle section 40 on whose one end a first end section 41 that is also at least substantially rod-shaped is provided. A first universal joint 411 is provided between the middle section 40 and the first end section 41. A second end section 42 that is also at least substantially rod-shaped is arranged at the other end of the middle section 40. A second universal joint 421 is provided between the middle section 40 and the second end section 42.

The universal joints 411, 421 are provided at the same position, in relation to the transverse direction, as the corresponding bearing elements to ensure that the pivot axes S1, S2 of the leg elements 1, 2 and the joint axes G1, G2 of the universal joints 411, 421 are each located substantially in one plane and coincide in the rotation position of the shaft 4 shown in FIG. 1 and in FIG. 2.

Figure 3:
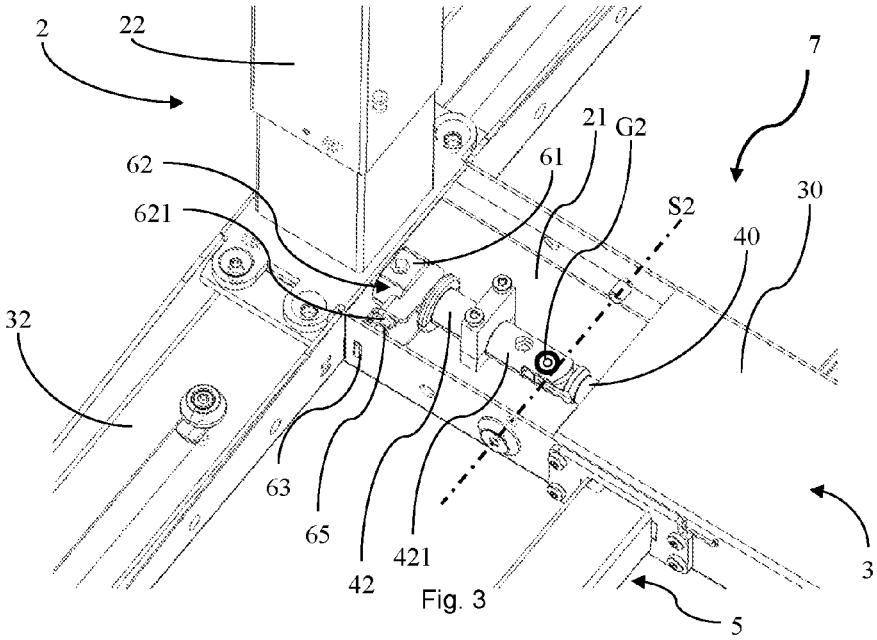
FIG. 3 shows a perspective detail view of the frame from FIG. 1 in a locked position.

As can be seen in detail in FIG. 3, a second eccentric 61 in the form of a cam is provided on the second end section 42 of the shaft 4. A gable-shaped second locking slide 62 can be actuated by means of the second eccentric 61, said locking slide serving as part of a locking arrangement.

A locking pin 621 is provided with a rectangular cross-section on an end of the locking slide 62 facing away from the shaft 40, said cross-section being guided in the blocking position through a second guide opening 63 provided on the transverse section 40 with an at least approximately corresponding cross-section. If, as illustrated in FIG. 3, the second joint axis G2 does not coincide with the second pivot axis S2, but rather intersects it, the locking slide 62 is pushed away from the eccentric 61 in the direction of the shaft 40 so that the locking pin 621 protrudes into or engages in the guide opening 63 provided on the transverse section 40. The locking pin 621 is brought into engagement with the second guide opening 63 with a positive locking connection. The second leg element 2 is hereby prevented from folding in so that the second leg element 2 is locked in the folded-out position. The first leg element 1 is, in this position, analogously locked in the folded-out position. A second spiral spring 65 is also provided between the second locking slide 62 and the second support element 11, said spring pressing the second locking slide 62 in the direction of the shaft 4 or the second end section 42 thereof.

Figure 4:
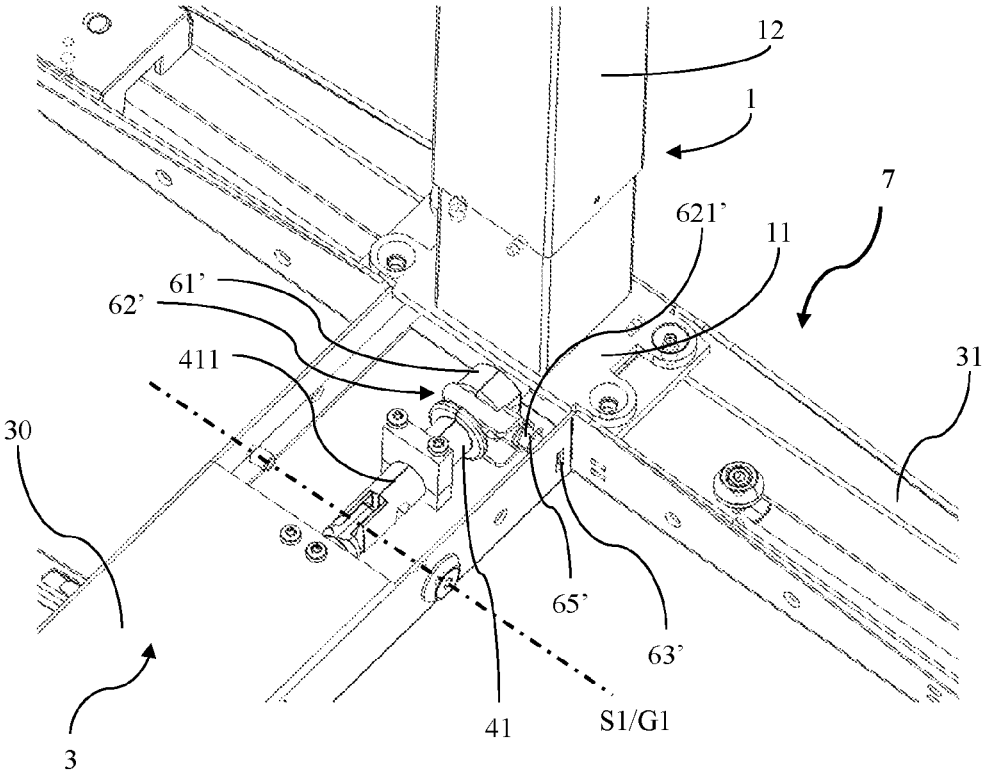
FIG. 4 shows a perspective detail view of the frame from FIG. 1 in an open position.

As can be seen in FIG. 4, the first end section 41 of the shaft 40 is fitted with an identical first eccentric 61' analogously to the second end section 42 described previously, said first eccentric 61' being in operative connection with an identical, gable-shaped, first locking slide 62' comprising a locking pin 621'. The first leg element 1 and the transverse section 40 of the shaft 4 also have a first guide or blocking opening 63' in one region of the first leg element 1. The first leg element 1 is thus locked or released correspondingly in a synchronous manner to the second leg element 1.

If the first joint axis G1, as shown in detail in FIG. 4 in relation to the first leg element 1, coincides with the first pivot axis S1 following rotation of the shaft 40 by means of the winder 5, the first eccentric 61' no longer presses on the locking slide 62', so that said locking slide can be pushed in the direction of the shaft 40 under the influence of a first spiral spring 65'. The first locking pin 621' is thus withdrawn from the first guide opening 63' and pivoting of the first leg element 1 is released. The frame 7 is now located in the release position and the leg elements 1, 2 can be folded in.

Although the invention is illustrated and described in detail by means of the figures and the associated description, this illustration and this detailed description should be understood to be illustrative and exemplary and do not limit the scope of the invention. In order not to transfigure the invention, well-known structures and techniques may not be shown and described in detail in some cases. It is understood that specialists may make changes and modifications without affecting the scope of the following claims. In particular, the present invention embraces additional exemplary embodiments with any combinations of features which may differ from feature combinations explicitly described.

The present disclosure also comprises embodiments with any combination of features which are mentioned or shown previously or below in relation to different designs or embodiments. It also comprises individual features in the figures even when they are shown there in connection with other features and/or are not mentioned previously or subsequently. The alternatives of embodiments described in the figures and the description and individual alternatives of their features may also be excluded from the subject matter of the invention or from the disclosed subject matters. The disclosure comprises embodiments which include exclusively the features described in the claims or in the exemplary embodiments, as well as those which include other additional features.

Moreover, the expression "comprise" and derivations thereof does not exclude other elements or steps. The indefinite article "a" and derivations thereof does not exclude a plurality. The functions of a plurality of features listed in the claims can be fulfilled by one unit or one step. The terms "substantially", "for example", "approximately" and the like in connection with a characteristic or a value also define precisely, and in particular, the characteristic or the value. The terms "for example" and "approximately" in connection with a given numerical value or range can relate to a value or range which is within 20%, within 10%, within 5% or within 2% of the given value or range. All reference numerals in the claims are not to be understood as limiting the scope of the claims.

The fact that a feature or a characteristic, for example a specific, in particular geometric shape is formed, provided or present at least approximately or substantially, can also mean, in particular, that production specifications exist which provide a guideline as to how the feature should be correspondingly formed, where a deviation from the guideline may result, particularly in the context of normal production tolerances.

The fact that an element or feature is elongated in one direction, runs in one direction or extends in one direction may mean, in particular, that dimensions of the element or feature are greater in or in relation to this direction than directions in or in relation to other, in particular all other directions, in particular orthogonal directions.

What is claimed is:

1. A height-adjustable frame for a furniture such as a table comprising:

a first leg element with a first support section, a first foot section and a first height adjustment component, the first height adjustment component being attached to the first foot section;

a second leg element with a second support section, a second foot section and a second height adjustment component, the second height adjustment component being attached to the second foot section;

wherein the first support section and the first foot section are movable relative to each other when the first height adjustment component is actuated by a first height adjustment element, wherein the second support section and the second foot section are movable relative to each other when the second height adjustment component is actuated by a second height adjustment element, and wherein the first leg element is configured to be pivoted about a first pivot axis between a folded-out position and a folded-in position and the second leg element is configured to be pivoted about a second pivot axis between a folded-out position and a folded-in position;

a rotatable shaft disposed between the first leg element and the second leg element, the rotatable shaft being operably coupled to the first and second height adjustment components of the first and second leg elements by the first and second height adjustment elements to synchronously actuate the first height adjustment component and the second height adjustment component when the shaft is rotated, wherein the rotatable shaft has a middle section, a first end section and a second end section, the first end section being connected via a first joint to the middle section to be pivotable towards the middle section about a first joint axis, and the second end section being connected via a second joint to the middle section to be pivotable towards the middle section about a second joint axis; and a locking structure that is configured to selectively lock and unlock the first and second leg elements, wherein the locking structure is configured to lock the first leg element and the second leg element in its folded-out position when the first and second joint axes of the first and second joints of the shaft do not run at least approximately parallel to the first and second pivot axes of the first and second leg elements or, in particular do not at least approximately coincide, and wherein the locking structure is configured to unlock when the first and second joint axes of the first and second joints of the shaft run at least approximately parallel to the first and second pivot axes of the first and second leg elements and, in particular, at least approximately coincide, so that each of the first leg element and the second leg element is free to be pivoted into its folded-in position.

2. The frame according to claim 1, further comprising a support element on which the first leg element is mounted pivotably about the first pivot axis, and on which the second leg element is mounted pivotably about the second pivot axis.

3. The frame according to claim 2, wherein the support element has a transverse section on which the first leg element and the second leg element are mounted spaced apart from each other.

4. The frame according to claim 3, wherein the shaft is disposed in an interior space of the transverse section of the support element.

5. The frame according to claim 1, wherein the first leg element and the second leg element are respectively pivotable between the folded-in position and the folded-out position independently of each other.

6. The frame according to claim 1, wherein the locking structure comprises a blocking component that can be actuated between a locking position, in which it blocks the pivoting of the first leg element and the second leg element, and a release position, in which the first leg element and the second leg element are released for pivoting.

7. The frame according to claim 6, wherein the blocking component of the locking structure is actuatable by rotation of the shaft between the locking position and the release position.

8. The frame according to claim 7, wherein the locking structure comprises an eccentric provided on the shaft, the eccentric being disposed to engage the blocking structure such that the blocking structure is moved between the locking position and the release position, depending on a rotation position of the shaft.

9. The frame according to claim 6, further comprising a support element on which the first leg element is mounted pivotably about the first pivot axis, and on which the second leg element is mounted pivotably about the second pivot axis, wherein the blocking component of the locking structure comprises a first locking pin which protrudes in the locking position into a first recess, the first recess being comprised of openings or depressions on the first leg element and the support element that are aligned when the first leg element is in its fold-out position, and a second locking pin which protrudes in the locking position into a second recess, the second recess being comprised of openings or depressions on the second leg element and the support element that are aligned when the second leg element is in its fold-out position.

10. The frame according to claim 9, wherein the first locking pin and the second locking pin are pressed in the locking position into the first recess and the second recess, and in the release position are moved out of the first recess and the second recess by respective eccentrics mounted on the rotatable shaft.

11. The frame according to claim 6, wherein the blocking component of the locking structure is resiliently pretensioned in a direction of the release position.

12. The frame according to claim 1, wherein the first joint is a first universal joint forming the first joint axis, the first universal joint being provided between the middle section of the shaft and the first end section of the shaft, and the second joint is a second universal joint forming the second joint axis, the second universal joint being provided between the middle section of the shaft and the second end section of the shaft.

13. The frame according to claim 1, wherein the middle section of the shaft, the first end section of the shaft and the second end section of the shaft are each rod-shaped.

14. The frame according to claim 1, further comprising a winder element operatively coupled with the shaft such that the shaft is put into rotation by rotating the winder element to thereby synchronously actuate the first height adjustment component and the second height adjustment component.

15. A table comprising:

a height-adjustable frame according to claim 1; and a worktop or table top which is mounted on the frame.

16. The frame according to claim 1, wherein each of the first and second height adjustment elements comprises a gear and each of the first and second height adjustment components comprises a rack or a spindle.

17. The frame according to claim 1, wherein the locking structure is first and second locking structures that are configured to selectively lock and unlock the first and second leg elements, respectively, wherein the first and second locking structures are configured to lock the first leg element and the second leg element in its respective folded-out position when the first and second joint axes of the first and second joints of the shaft do not run at least approximately parallel to the first and second pivot axes of the first and second leg elements or, in particular do not at least approximately coincide, and wherein the first and second locking structures are configured to unlock when the first and second joint axes of the first and second joints of the shaft run at least approximately parallel to the first and second pivot axes of the first and second leg elements and, in particular, at least approximately coincide, so that the first leg element and the second leg element are free to be pivoted into its respective folded-in position.

* * * * *